US007004049B2

(12) United States Patent
So

(10) Patent No.: US 7,004,049 B2
(45) Date of Patent: Feb. 28, 2006

(54) MULTI-PURPOSE OPENER

(76) Inventor: Shun So, 2nd Floor, Chuan Yuan Factory Building, 342-344 Kwun Tong Road, Kwun Tong, Kowloon, Hong Kong (CN)

( * ) Notice: Subject to any disclaimer, the term of this patent is extended or adjusted under 35 U.S.C. 154(b) by 9 days.

(21) Appl. No.: 10/832,071

(22) Filed: Apr. 26, 2004

(65) Prior Publication Data

US 2004/0255722 A1 Dec. 23, 2004

(30) Foreign Application Priority Data

May 2, 2003 (EP) ..... 03252781

(51) Int. Cl.
*B67B 7/44* (2006.01)

(52) U.S. Cl. ..... 81/3.09; 30/418; 7/152

(58) Field of Classification Search ..... 81/3.09, 81/3.08, 3.33, 3.27, 3.4, 3.44, 3.55, 3.57, 81/3.48; 7/152, 156; 30/416–418, 422, 30/424, 425, 440

See application file for complete search history.

(56) References Cited

U.S. PATENT DOCUMENTS 4,455,894 A 6/1984 Roberts
4,723,465 A 2/1988 Hughes
4,911,038 A 3/1990 Ferrin
4,979,407 A 12/1990 Hernandez
5,787,592 A * 8/1998 Lai ..... 30/418
6,058,613 A 5/2000 So
6,105,468 A 8/2000 Fohrman et al.
6,179,138 B1 1/2001 Puleston
2001/0022030 A1 9/2001 Herren

FOREIGN PATENT DOCUMENTS

WO WO/9118822 12/1991
WO WO/9964343 12/1999

* cited by examiner

*Primary Examiner*—Debra S Meislin
(74) *Attorney, Agent, or Firm*—Alix, Yale & Ristas, LLP

(57) ABSTRACT

A multi-purpose opener for removing a closure from a variety of containers has a sleeve having a first end with an opening for receiving a screw cap within the sleeve. The sleeve has an internal wall with one or more projections for engaging the screw cap, and a second end with a slot having a blade for engaging a bottle cap. A handle is integral with the sleeve and extends radically there from. The distal end of the handle has a taper for engaging under the lift tab of drink can. A claw for engaging a ring pull tab of a can is integral with the sleeve and extends tangentially from the sleeve diametrically opposite the handle.

10 Claims, 6 Drawing Sheets

MULTI-PURPOSE OPENER

BACKGROUND OF THE INVENTION

1. Field of the Invention

The invention relates to openers for removing a closure from a container, and in particular to a multi-purpose opener for removing closures from a variety of containers such as bottles and cans.

2. Description of Prior Art

There are a large variety of closures for cans and bottles including conventional bottles caps, screw top closures, lid tabs and ring pull openers for food cans.

These closures are design designed to allow a person to open the container without the aid of tools. However, most closures can be difficult to remove for people with short finger nails or weak or arthritic hands. A variety of tools are available to aid in removing closures. However, most of these tools are directed at one specific type of closure and there are few tools on the market which are multi-purpose and directed at removing closures from a variety of containers.

SUMMARY OF THE INVENTION

It is an object of the present invention to provide a multi-purpose opener for removing closures from a variety of containers, or at least to provide the public with a useful alternative.

According to a first aspect of the invention there is provided a multi-purpose opener for removing closures from a variety of containers including a sleeve having a first end with an opening for receiving a screw cap within the sleeve and an internal wall including one or more projections for engaging the screw cap, a handle extending radially from the sleeve and having a tapered portion for engaging under the lift tab of a drink can, and a claw extending tangentially from the sleeve member.

Preferably, the sleeve includes a second end with a slot and a blade adjacent an edge of the slot.

Preferably, a ring is located with the internal wall of the sleeve and is provided with teeth for engaging the screw cap.

Preferably, there are thicker portions at either side of the tapered portion.

Preferably, the claw includes a heal portion with a smooth transition to the sleeve.

According to a second aspect of the invention there is provided a can opener including a first operating element having a first handle member, a second operating element having a second handle member, the first and second operating elements being pivotally connected to each other, a traction wheel rotatably mounted with the first operating element, a cutter blade rotatably mounted with the second operating element, wherein movement of the handles relative each other moves the traction wheel and cutter blade between an inoperative position to receive a rim of a can there between and an operative position in which the traction wheel and cutter blade engage the rim of the can, the first handle including a sleeve having a first end with an opening for receiving a screw cap within the sleeve, an internal wall including one or more projections for engaging the screw cap, and a second end with a slot and a blade adjacent an edge of the slot, and the second handle including a tapered portion for engaging under the lift tab of drink can.

Preferably, a claw extends tangentially from the sleeve member.

Preferably, the claw includes a heal portion with a smooth transition with the sleeve.

Preferably, a ring is located with the internal wall of the sleeve and is provided with teeth for engaging the screw cap.

Preferably, there are thicker portions at either side of the tapered portion.

Further aspects of the invention will become apparent from the following description, which is given by way of example only.

BRIEF DESCRIPTION OF THE DRAWINGS

An embodiment of the invention will now be described by way of example only and with reference to the accompanying drawing, in which.

DESCRIPTION OF THE PREFERRED EMBODIMENTS

Figures 1, 2, 3:
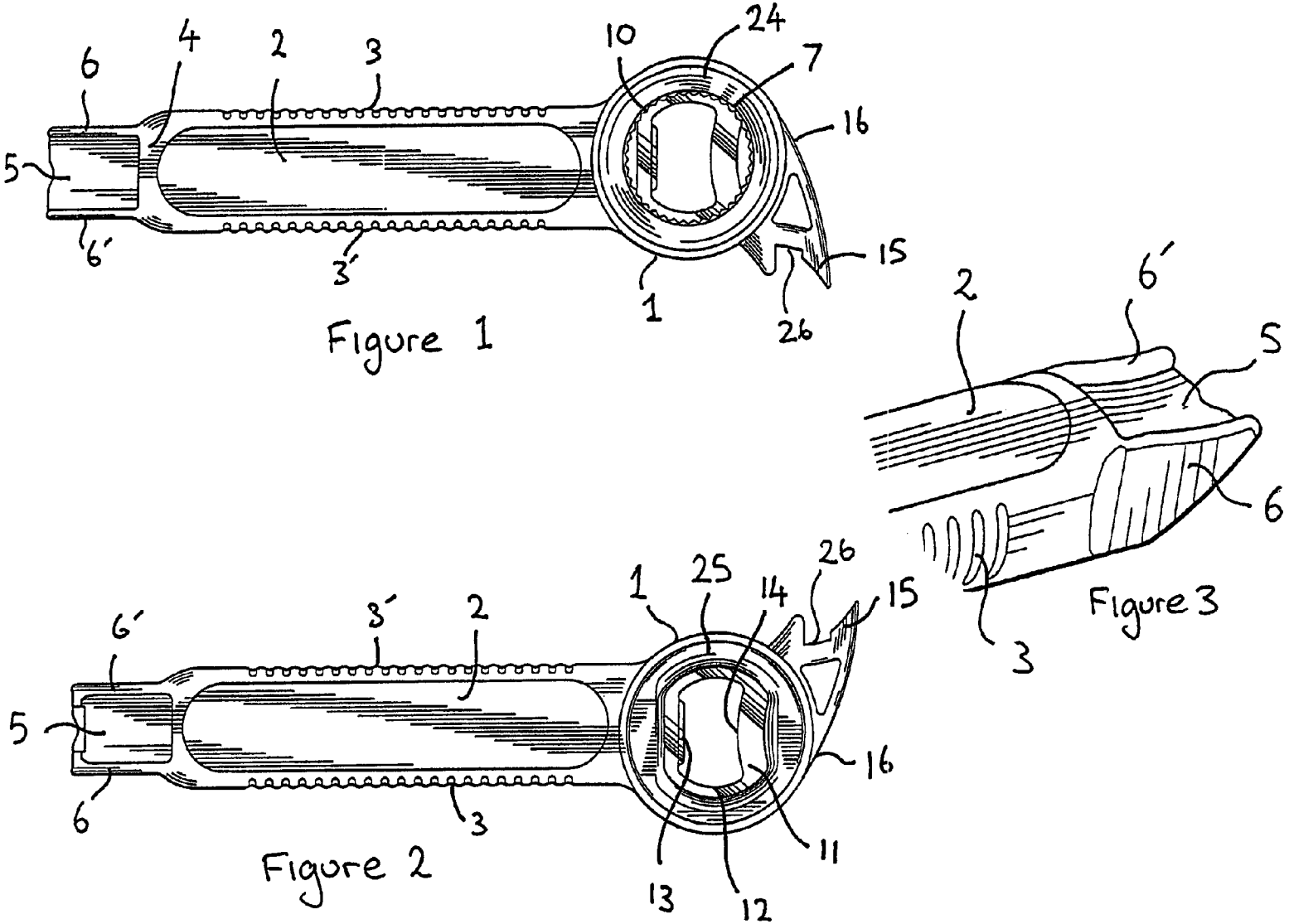
FIG. 1 is a first side view of an opener according to the invention.
FIG. 2 is a second side view of the opener of FIG. 1.
FIG. 3 is a first side perspective view of the distal end of the opener handle.
Figure 5:
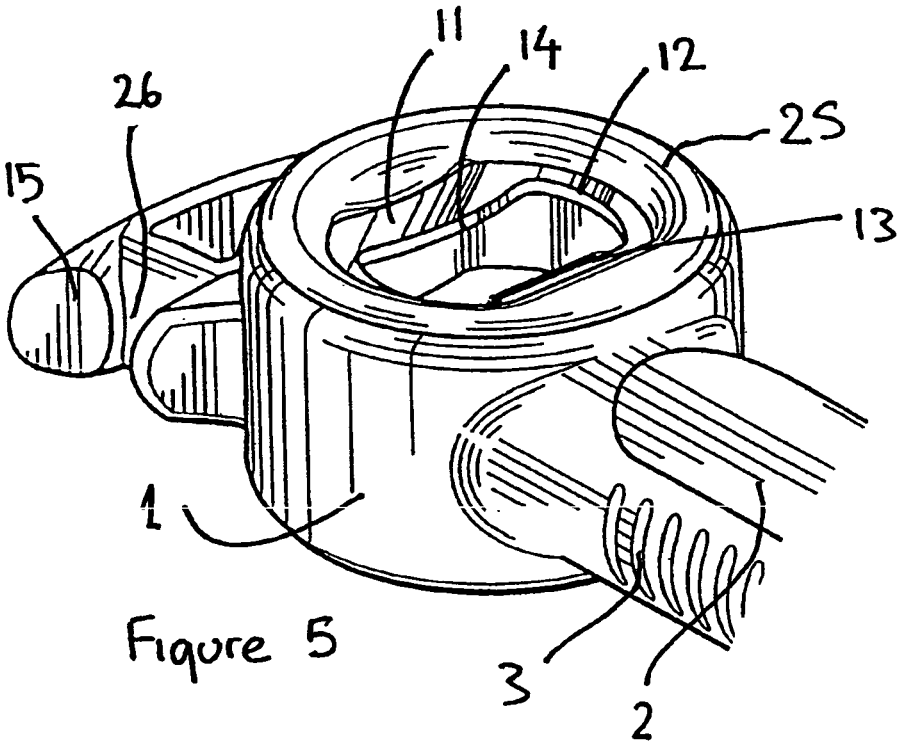
FIG. 5 is a second side perspective view of the opener head.
Figure 4:
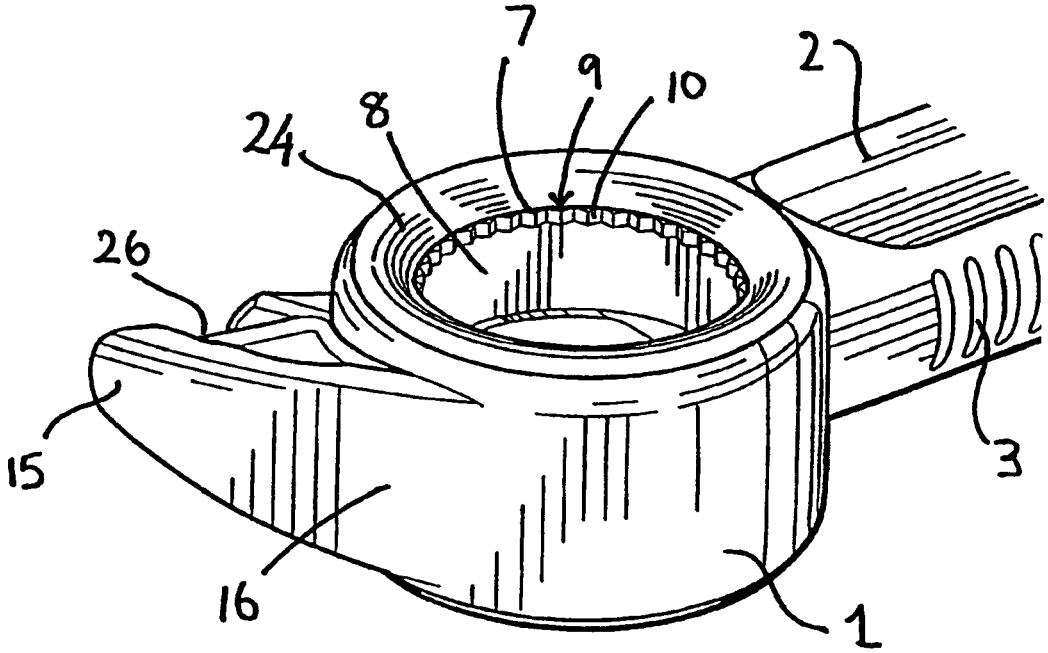
FIG. 4 is a first side perspective view of the opener head.

In the drawings like reference numerals represent like elements.

Referring to FIGS. 1 to 5, a multi-purpose opener according to the invention comprises a sleeve shaped head 1 integrally formed with a handle 2 that extends radially from the head 1. The edges of handle 2 are provided with ribs 3 to allow a firm but comfortable grip of the handle 2.

The distal end 4 of handle 2, opposite head 1, has a tapered portion 5 for engaging under the lift tab of a drink can. At either side of tapered portion 5 are thicker edges 6, 6'. Thicker edges 6 are provided to limit the sideways motion of the lift tab on tapered portion 5. Without edges 6 the tab might sway or the tapered portion 5 might slip out from under the tab when the user tries to lift the tab. The edges 6 also provide additional strength to tapered portion 5 so that it does not break or snap off when being used to lift the lift tab of a drink can.

A first side 24 of the sleeve of head 1 has an opening 7 which is fractionally bigger than the standard size of a drink bottle screw top. The inner wall 8 of opening 7 has a groove 9. Located within groove 9 is a steel ring 10 with a plurality of inwardly projecting teeth. When a drink bottle screw top is receive received within opening 7, the teeth of ring 10 grip the edges of the screw top.

The second side 25 of head 1 includes a metal disc 11 which has an elongate slot 12 in it. One edge of the elongate slot 12 has a blade 13 for engaging the edge of a bottle top. The other edge 14 of elongate slot 12 is curved for sitting on the top of the bottle top and providing a pivot point for lifting the bottle top edge with blade 13.

Extending from head 1 diametrically opposite handle 2 is a claw 15. A slot 26 is provided adjacent the distal end of the claw 15 for receiving the ring of a pull tab of a food can. The claw 15 has a heal portion 16 which has a smooth transition to the periphery of head 1.

Figure 7:
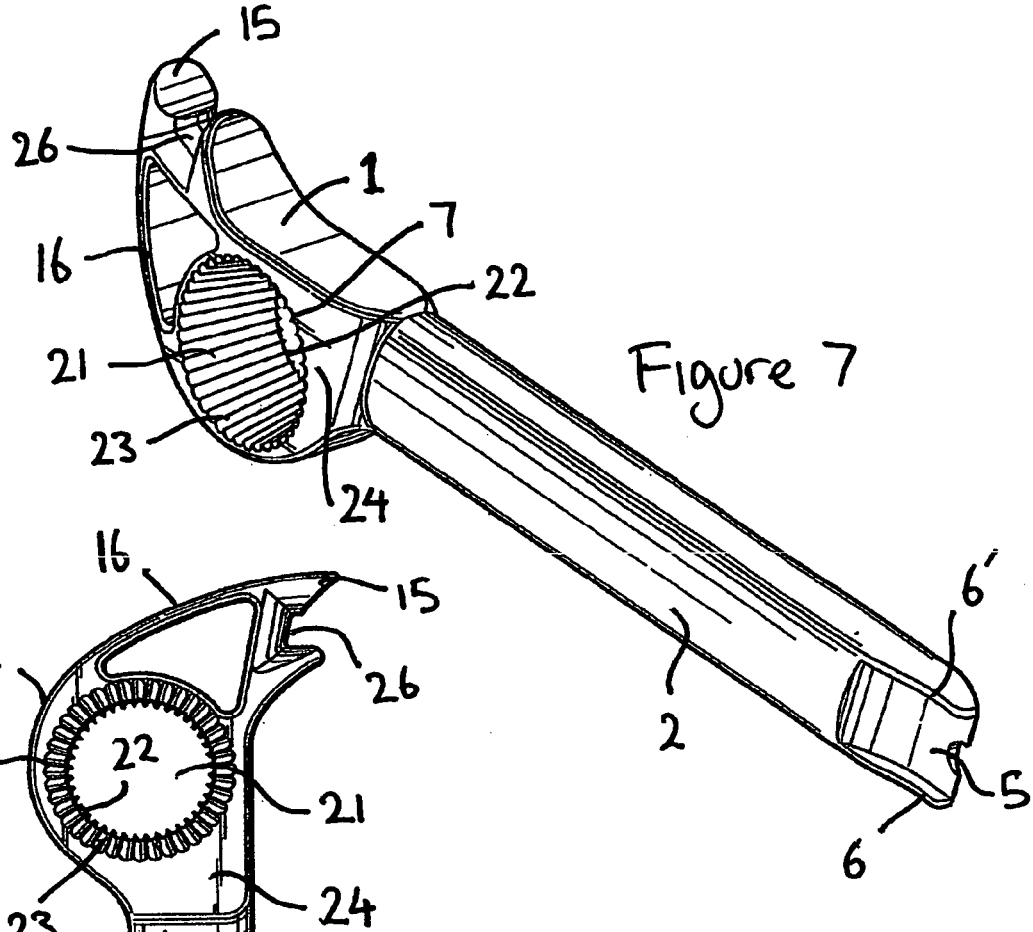
FIG. 7 is a perspective view of the opener of FIG. 6.
Figure 6:
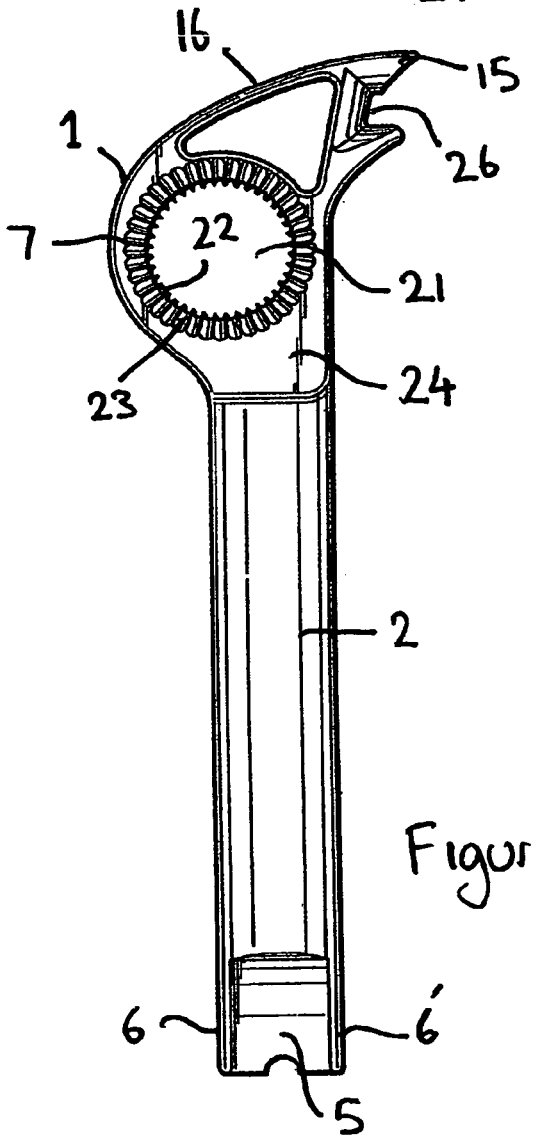
FIG. 6 is a side view of an alternative embodiment of an opener according to the invention.

Referring to FIGS. 6 and 7, an alternative embodiment of the invention is provided with a sleeve shaped head 1 integrally formed with a handle 2 that extends radially from the head 1. The end 4 of handle 2 has a tapered portion 5 for engaging under the lift tab of a drink can. Either side of tapered portion 5 are thicker edges 6.

Sleeve shaped head 1 has a frustum shaped passage 21 through it. The opening 7 in fist side 24 of the sleeve 1 is at the larger end of the frustum shaped passage 21. An opening 22 in the second side of the sleeve is at the smaller diameter end of the frustum shaped passage 21. The diameter of opening 7 is larger than the diameter of a standard drink bottle screw top. The diameter of opening 22 is smaller than the diameter of a standard drink bottle top.

The inner surface 23 of frustum shaped passage 21 is fluted forming a plurality of longitudinal teeth around the inner circumference of wall 23. A bottle top passes through opening 7 into frustum shaped passage 21 and is engaged and gripped by the longitudinal teeth of tapering wall 23 of passage 21.

Extending from head 1 diametrically opposite handle 2 is a claw 15. A slot 26 is provided adjacent the distal end of the claw 15 for receiving the ring of a pull tab of a food can. The claw 15 has a heal portion 16 which has a smooth transition to the periphery of head 1.

Figure 8:
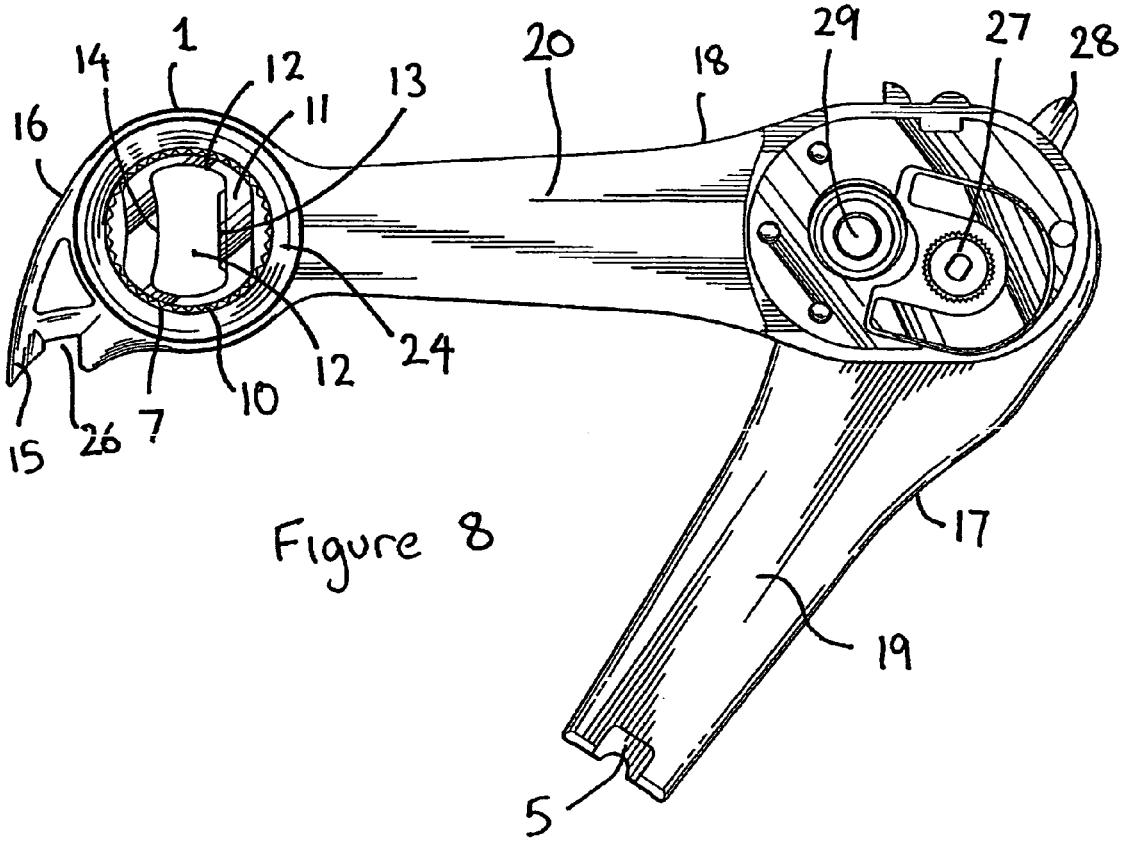
FIG. 8 is a first perspective view of a can opener incorporating an opener according to the invention.
Figure 9:
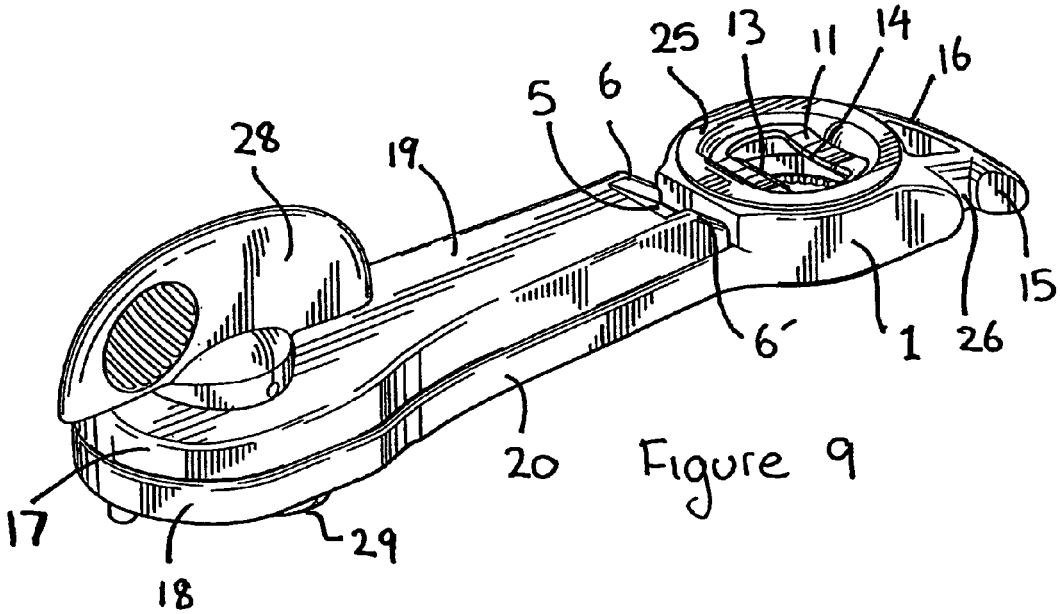
FIG. 9 is a second perspective view of the can opener of FIG. 4.

FIGS. 8 and 9 illustrate combination of a multi-purpose opener and a can opener. The can opener comprises first and second operating elements 17, 18. Each operating element is integrally formed with a handle 19, 20. The operating elements 17, 18 are pivoted at their ends opposite the handles 19, 20. A traction wheel 27 is rotatably mounted on first operating element 17. A shaft extends thought first operating element 17 to a knob 28. Turning knob 28 rotates traction wheel 27. A cutter wheel 29 is mounted on second operating element 18.

Movement of the handles 19, 20 relative each other moves the traction wheel 27 and cutter blade 29 between an operative position to receive a rim of a can there between and an inoperative position in which the traction wheel 27 and cutter blade 29 engage the rim of the can. The above described can opener is known in the art.

The distal end of first handle 19 is provided with tapered portion 5, as illustrated and described with reference to FIG. 3, for engaging under the lift tab of a drink can. The distal end of second handle 20 has a sleeve shaped head 1 integrally formed with the handle 20. Head 1 has all the features describe above with reference to FIGS. 4 and 5. In an alternative embodiment the head 1 has the features described above with reference to FIGS. 6 and 7.

The can opener can be used to remove the top from a can in known manner. It can also be used to remove the closures from other containers utilising tapered portion 5 and the features of head 1.

Figure 10:
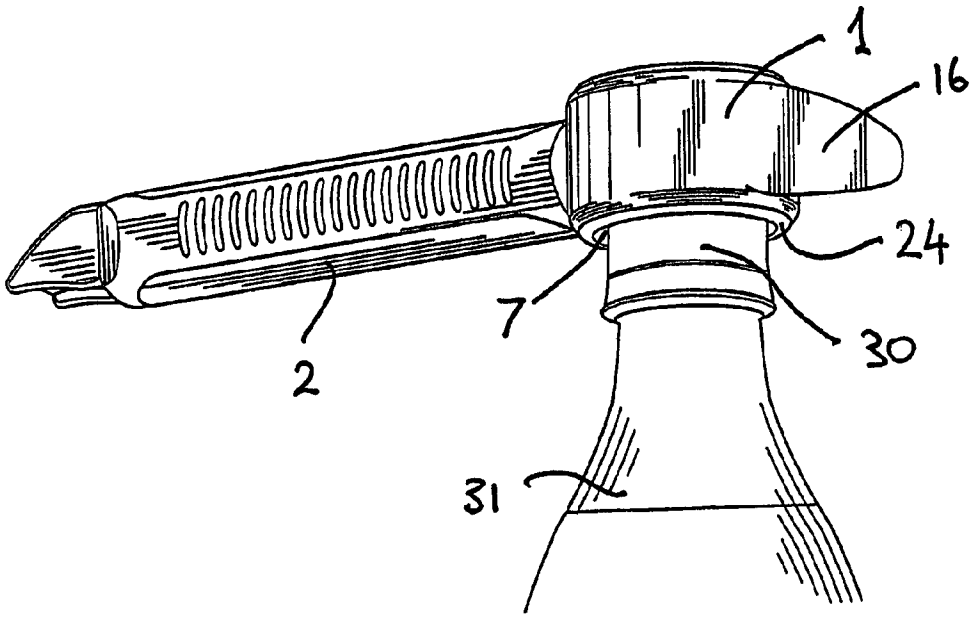
FIG. 10 illustrates use of the opener of FIG. 1 to remove a screw top closure.

FIGS. 10 to 13 illustrate use of a multi-purpose opener opener. In FIG. 10 the screw cap 30 of a drink bottle 31 is received within opening 7 in first side 24 of head 1. Teeth of metal ring 10 engage the screw cap 30 which can then be removed by turning the opener. Elongate handle 2 provides leverage to make opening easy.

Figure 11:
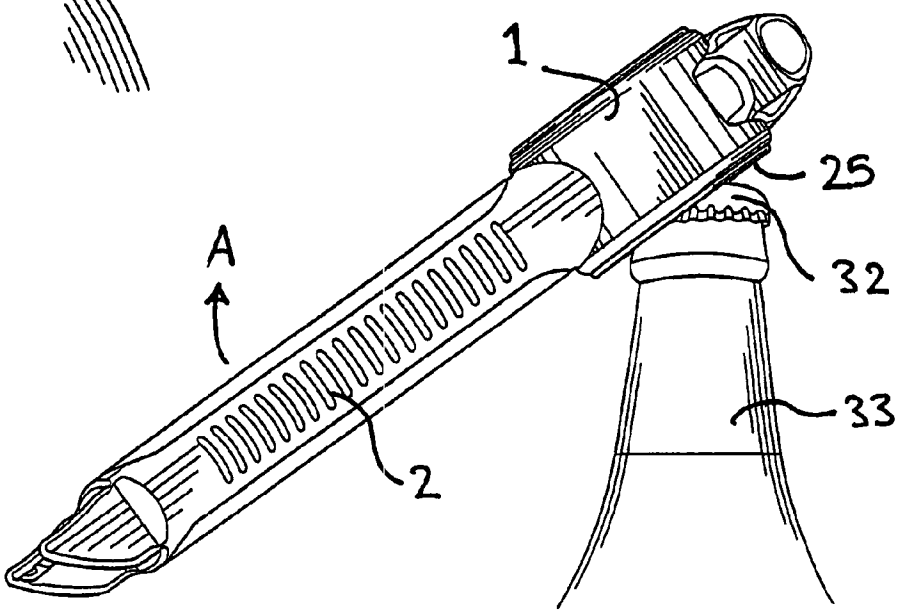
FIG. 11 illustrates use of the opener of FIG. 1 to remove a bottle cap.

In FIG. 11 blade 13 of metal disc 11 on second side 25 of the head 1 is use to remove the cap 32 of a drink bottle 33. The blade 13 is position positioned underneath the edge of the bottle cap 32 with curve edge 14 on top of the bottle cap 32. Upward movement of handle 2, in the direct direction of arrow A, removes the bottle cap 32 in known manner by lifting the edge of the top. The opener pivots about curved edge 14 on the top of bottle top 32.

Figure 12:
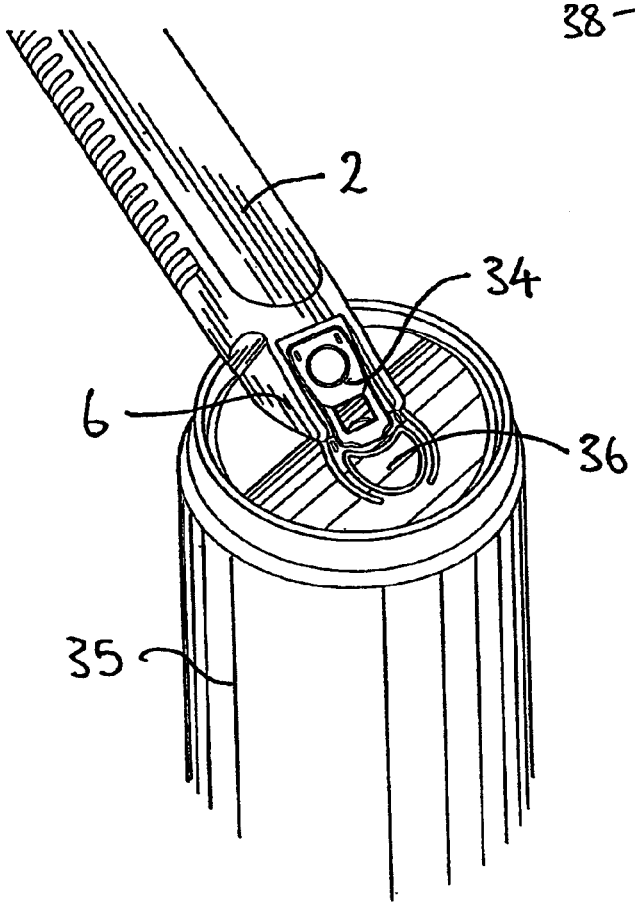
FIG. 12 illustrates use of the opener of FIG. 1 to lift a lift tab opener on a drink can.

In FIG. 12 tapered portion 5 of handle 2 is used to lift the lift tab 34 of a drink can 35. Taper edge 5 is engage engaged underneath the lift tab 34 and the lift tab 34 is rotated by upwards movement of handle 2 to push in the closure 36 of the drink can 35.

Figure 13:
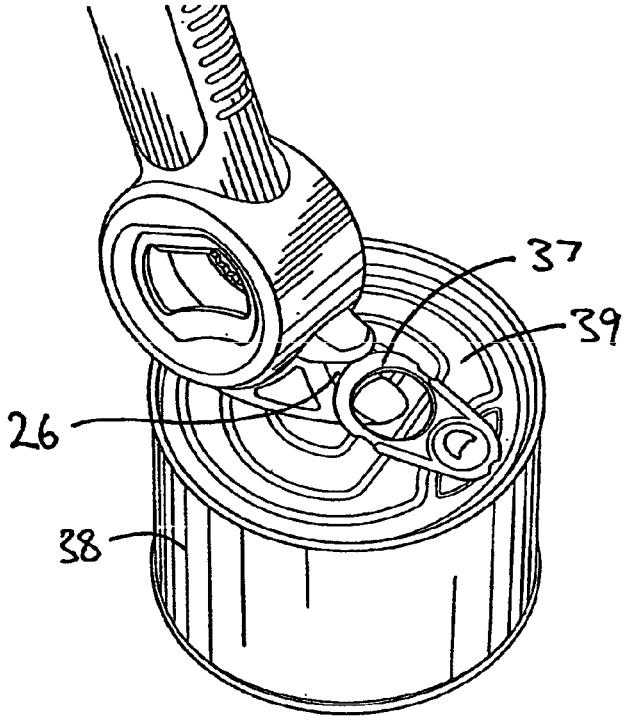
FIG. 13 illustrates use of the opener of FIG. 1 to pull a ring pull tab on a food can.

In FIG. 13 the claw 15 is used to pull the ring pull 37 of a food can 38. The ring 37 is engaged in the slot 26 of claw 15 and heal 16 is placed against the top of the can closure 39. By rocking the opener on heal 16, claw 15 lifts up through the ring 37 the can closure 39 to tear it from the can 38.

Where in the foregoing description reference has been made to integers or elements which have known equivalents, then such are included as if individually set forth herein.

Embodiments of the invention having been described, however it is understood that variations, improvements or modifications can take place without departure from the spirit of the invention or scope of the appended claims.

What is claimed is:

1. A can opener including:

a first operating element having a first handle member, a second operating element having a second handle member, the first and second operating elements being pivotally connected to each other, a traction wheel rotatably mounted with the first operating element, a cutter blade rotatably mounted with the second operating element, wherein movement of the handles relative to each other moves the traction wheel and cutter blade between an inoperative position to receive a rim of a can therebetween and an operative position in which the traction wheel and cutter blade engage the rim of the can, the first handle including a sleeve having a first end with an opening for receiving a screw cap within the sleeve, an internal wall including one or more projections for engaging the screw cap, and a second end with a slot and a blade adjacent an edge of the slot, and the second handle including a tapered portion for engaging under the lift tab of a drink can.

2. The can opener of claim 1 wherein a claw extends tangentially from the sleeve member.

3. The opener of claim 2 wherein the claw includes a heal portion with a smooth transition with the sleeve.

4. The can opener of claim 1 wherein a ring is located with the internal wall of the sleeve and is provided with teeth for engaging the screw cap.

5. The opener of claim 1 wherein there are thicker portions at either side of the tapered portion.

6. The can opener of claim 2 wherein a ring is located with the internal wall of the sleeve and is provided with teeth for engaging the screw cap.

7. The can opener of claim 3 wherein a ring is located with the internal wall of the sleeve and is provided with teeth for engaging the screw cap.

8. The opener of claim 2 wherein there are thicker portions at either side of the tapered portion.

9. The opener of claim 3 wherein there are thicker portions at either side of the tapered portion.

10. The opener of claim 4 wherein there are thicker portions at either side of the tapered portion.

* * * * *